US012800224B2

(12) United States Patent
Li et al.

(10) Patent No.: US 12,800,224 B2
(45) Date of Patent: Nov. 17, 2026

(54) AIR SEPARATION SYSTEM AND AIR SEPARATION METHOD

(71) Applicant: L'Air Liquide, Societe Anonyme pour l'Etude et l'Exploitation des Procedes Georges Claude, Paris (FR)

(72) Inventors: Jianwei Li, Hangzhou (CN); Xianbiao Zheng, Hangzhou (CN)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 138 days.

(21) Appl. No.: 18/757,388

(22) Filed: Jun. 27, 2024

(65) Prior Publication Data

US 2025/0003679 A1 Jan. 2, 2025

(30) Foreign Application Priority Data

Jun. 27, 2023 (CN) ..... 202310773067.8

(51) Int. Cl.
*F25J 3/04* (2006.01)

(52) U.S. Cl.
CPC ..... *F25J 3/04818* (2013.01); *F25J 3/04357* (2013.01); *F25J 3/04412* (2013.01);
(Continued)

(58) Field of Classification Search
CPC .. F25J 3/04818; F25J 3/04357; F25J 3/04412; F25J 3/04787; F25J 2200/06;
(Continued)

(56) References Cited

U.S. PATENT DOCUMENTS

2002/0066289 A1* 6/2002 Spoeri ..... F25J 3/04224 62/643

FOREIGN PATENT DOCUMENTS

CN 108 072 235 5/2018
CN 112414003 2/2021
(Continued)

OTHER PUBLICATIONS

EP Search Report for EP 24 18 3635, mailed Dec. 10, 2024.

*Primary Examiner* — Joel M Attey
*Assistant Examiner* — Ibrahim A. Michael Adeniji
(74) *Attorney, Agent, or Firm* — Justin K. Murray

(57) ABSTRACT

The present invention provides an air separation system and an air separation method. The air separation system comprises an air separation apparatus and a nitrogen liquefier. In the air separation apparatus, multiple output pipelines are led out from a rectification column system via a main heat exchanger. In the nitrogen liquefier, a gas delivery pipeline delivers a gas flow expanded by an expander. The air separation system further comprises an intermediary pipeline. An inlet end of the intermediary pipeline is connected to the gas delivery pipeline of the nitrogen liquefier, and an outlet end of the intermediary pipeline is connected to at least one of the multiple output pipelines of the air separation apparatus at a position between the rectification column system and the main heat exchanger, such that the intermediary pipeline delivers a gas flow to the at least one output pipeline. The air separation system and air separation method can be started up smoothly without the use of liquid nitrogen stored externally in reserve.

6 Claims, 2 Drawing Sheets

(52) U.S. Cl.
CPC ..... *F25J 3/04787* (2013.01); *F25J 2200/06* (2013.01); *F25J 2205/02* (2013.01); *F25J 2210/40* (2013.01); *F25J 2230/04* (2013.01); *F25J 2230/42* (2013.01); *F25J 2240/44* (2013.01); *F25J 2260/20* (2013.01); *F25J 2270/42* (2013.01); *F25J 2280/10* (2013.01)

(58) Field of Classification Search
CPC .. F25J 2205/02; F25J 2210/40; F25J 2230/04; F25J 2230/42; F25J 2240/44; F25J 2260/20; F25J 2270/42; F25J 2280/10; F25J 3/04393; F25J 2245/42; F25J 2270/06; F25J 2290/34; F25J 1/0015; F25J 1/0035; F25J 1/0037; F25J 1/004; F25J 1/0045; F25J 1/0202; F25J 1/0234; F25J 3/04224; F25J 3/0257; F25J 3/04109
See application file for complete search history.

(56) References Cited

FOREIGN PATENT DOCUMENTS

| | | | | |
|---|---|---|---|---|
| CN | 112 781 321 | | 5/2021 | |
| CN | 112781321 | A * | 5/2021 | ..... F25J 3/04309 |
| EP | 0 042 676 | | 12/1981 | |
| EP | 0042676 | A1 * | 12/1981 | ..... F25J 3/04375 |
| JP | 2002 168 561 | | 6/2002 | |

* cited by examiner

AIR SEPARATION SYSTEM AND AIR SEPARATION METHOD

CROSS REFERENCE TO RELATED APPLICATIONS

This application claims the benefit of priority under 35 U.S.C. § 119 (a) and (b) to Chinese patent application No. CN2023/10773067.8, filed Jun. 27, 2023, which is herein incorporated by reference in its entirety.

TECHNICAL FIELD

The present invention relates to an air separation system and air separation method, in the field of air separation.

BACKGROUND ART

Air separation apparatuses are widely used in various industries. Many users of air separation apparatuses equip nitrogen liquefiers to liquefy a nitrogen gas product produced by the air separation apparatus, so as to obtain liquid nitrogen. In this case, the air separation apparatus and the nitrogen liquefier form an air separation system.

The air separation apparatus separates the feedstock air in a rectification column through the mechanism of cryogenic air separation, so as to form a variety of air products; thus, it is necessary to supply the cold to the rectification column, to bring its operating temperature to the required low temperature. In particular, the air separation apparatus in the above-mentioned air separation system often does not have an expander for refrigeration, and in normal operation, the cold is often supplied by a return stream of liquid nitrogen produced by the nitrogen liquefier.

However, at a start-up stage, the rectification column needs to be cooled from room temperature to the required low temperature. In order to do this, a common approach for the above-mentioned air separation apparatus at present is to use the liquid nitrogen stored in a backup system. When the air separation apparatus has just been switched on, low-temperature liquid nitrogen is delivered to the rectification column from the external backup system, so as to supply the cold to the rectification column, to cool it to the required low temperature.

However, it's analyzed by the inventors that, if a sufficient amount of liquid nitrogen for start-up is to be stored in reserve, a corresponding backup facility must be constructed or enlarged. In addition to that, the liquid nitrogen itself is expensive. This increases the cost for the user. Furthermore, some users are located in remote areas, and it is not easy to store low-temperature liquid nitrogen in reserve in advance before the air separation apparatus produces air products such as nitrogen gas products. In addition, it is further analyzed that when the liquid nitrogen stored in reserve is used to cool the rectification column, the cooling rate is generally fast, and sometimes difficult to control. As a result, the air separation apparatus, or even the entire air separation system comprising other apparatuses besides the air separation apparatus, will experience material deformation due to sudden cooling, which leads to failure or other problems.

Thus, it's needed to provide a solution that can replace the use of liquid nitrogen stored externally in reserve for supplying the cold, and enables smooth start-up.

SUMMARY OF THE INVENTION

An object of certain embodiments of the present invention is to provide an air separation system that can be started up smoothly without the use of liquid nitrogen stored externally in reserve.

Another object of the present invention is to provide an air separation system that can reduce the cost of start-up.

Yet another object of the present invention is to provide an air separation system that can make it less likely that the cooling rate of the entire air separation system during start-up will be too fast, which is therefore safer and more reliable.

In certain embodiments, the present invention may provide an air separation system, comprising an air separation apparatus and a nitrogen liquefier. The air separation apparatus comprises a rectification column system, a main heat exchanger and multiple output pipelines. The multiple output pipelines are led out from the rectification column system via the main heat exchanger, and the multiple output pipelines comprise a nitrogen gas pipeline for outputting a nitrogen gas product. The nitrogen liquefier comprises an expander for expanding at least a portion of the nitrogen gas product from the nitrogen gas pipeline, and a gas delivery pipeline for delivering a gas flow expanded by the expander. The air separation system further comprises an intermediary pipeline. An inlet end of the intermediary pipeline is connected to the gas delivery pipeline of the nitrogen liquefier, and an outlet end of the intermediary pipeline is connected to at least one of the multiple output pipelines of the air separation apparatus at a position between the rectification column system and the main heat exchanger, such that the intermediary pipeline delivers a gas flow to the at least one output pipeline.

In an embodiment, the nitrogen liquefier further comprises an internal heat exchanger, a gas-liquid separator and a throttle valve. The gas delivery pipeline delivers a gas flow from the expander to the internal heat exchanger to be heated. The gas-liquid separator is located on the gas delivery pipeline and between the expander and the internal heat exchanger. The gas-liquid separator collects a gas flow expanded by the expander and a stream throttled by the throttle valve, and separates all collected fluids into a gas phase flow and a liquid phase flow.

In an embodiment, the inlet end of the intermediary pipeline is connected to the gas delivery pipeline at a position between the expander and the internal heat exchanger.

In an embodiment, the inlet end of the intermediary pipeline is connected to the gas delivery pipeline at a position between the gas-liquid separator and the internal heat exchanger.

In an embodiment, the nitrogen liquefier further comprises a liquid return pipeline and a liquid delivery pipeline. The liquid return pipeline is used to send a first part of liquid flow in the liquid phase flow separated out by the gas-liquid separator back to the rectification column system. The liquid delivery pipeline is used to output a second part of liquid flow in the liquid phase flow separated out by the gas-liquid separator to a storage tank.

In an embodiment, in the nitrogen liquefier, an outlet end of the gas delivery pipeline is connected to the nitrogen gas pipeline, so as to send a gas flow heated in the internal heat exchanger to the nitrogen gas pipeline to converge with a nitrogen gas product of the nitrogen gas pipeline.

In an embodiment, the air separation system further comprises a gas flow regulating component, a liquid flow regulating component, a controller and a detection element. The gas flow regulating component regulates the flow rate of a gas flow of the intermediary pipeline. The liquid flow regulating component regulates the flow rate of a liquid flow of the liquid return pipeline and/or the liquid delivery pipeline. The controller controls the gas flow regulating component and/or the liquid flow regulating component according to a control signal. The detection element sends a detection signal to the controller, which generates the control signal according to the detection signal of the detection element.

In an embodiment, the at least one output pipeline is a waste discharge pipeline of the air separation apparatus for delivering waste gas.

The present invention further provides an air separation method. The air separation method uses the air separation system described above. Moreover, in the air separation method, at a start-up stage of an air separation apparatus of the air separation system, a gas flow is delivered to at least one output pipeline of the air separation apparatus from a nitrogen liquefier of the air separation system, via an intermediary pipeline of the air separation system.

In an embodiment, when the start-up stage begins, the intermediary pipeline is opened, and a liquid return pipeline and a liquid delivery pipeline of the nitrogen liquefier are closed; at the start-up stage, nitrogen purity in a nitrogen gas pipeline of the air separation apparatus and/or a gas-liquid separator of the nitrogen liquefier is detected, and a liquid level in the gas-liquid separator is detected; when the liquid level in the gas-liquid separator reaches a predetermined value, the liquid return pipeline is opened; when the nitrogen purity in the nitrogen gas pipeline and/or the gas-liquid separator reaches a predetermined value, it is determined that the start-up stage has ended and an operating stage is entered; and at the operating stage, the liquid delivery pipeline is opened, and the intermediary pipeline is closed.

In an embodiment, in the start-up stage, a rate of temperature decrease at a fixed site in an internal heat exchanger of the nitrogen liquefier is further detected, and the flow rate of a gas flow sent to the nitrogen gas pipeline by the gas delivery pipeline via the internal heat exchanger is regulated, such that the detected rate of temperature decrease is within 2° C./min.

In the air separation system and air separation method described above, the nitrogen liquefier of the air separation system itself is utilized to deliver to the air separation apparatus a gas flow cooled by expansion in the expander in the nitrogen liquefier, which can supply the cold for start-up of the air separation apparatus, thus enabling smooth start-up without the use of liquid nitrogen stored externally in reserve. Thus, there is no need to construct a corresponding backup facility, and no need to store relatively expensive liquid nitrogen in reserve in advance, so start-up costs less and becomes easier.

Moreover, in the air separation system and air separation method described above, the gas flow cooled by expansion in the expander in the nitrogen liquefier cools down gradually, and thus supplies the cold to the rectification column system of the air separation apparatus progressively. Thus, during start-up, the cooling rate of the entire air separation system is less likely to be too fast, and is easy to control, making the system safer and more reliable. The problem like failure caused by a too fast cooling rate are less likely to occur.

BRIEF DESCRIPTION OF THE DRAWINGS

A better understanding of the advantages and spirit of the present invention can be gained from the detailed description of the invention below and the accompanying drawings.

DETAILED DESCRIPTION OF THE INVENTION

Figure 1:
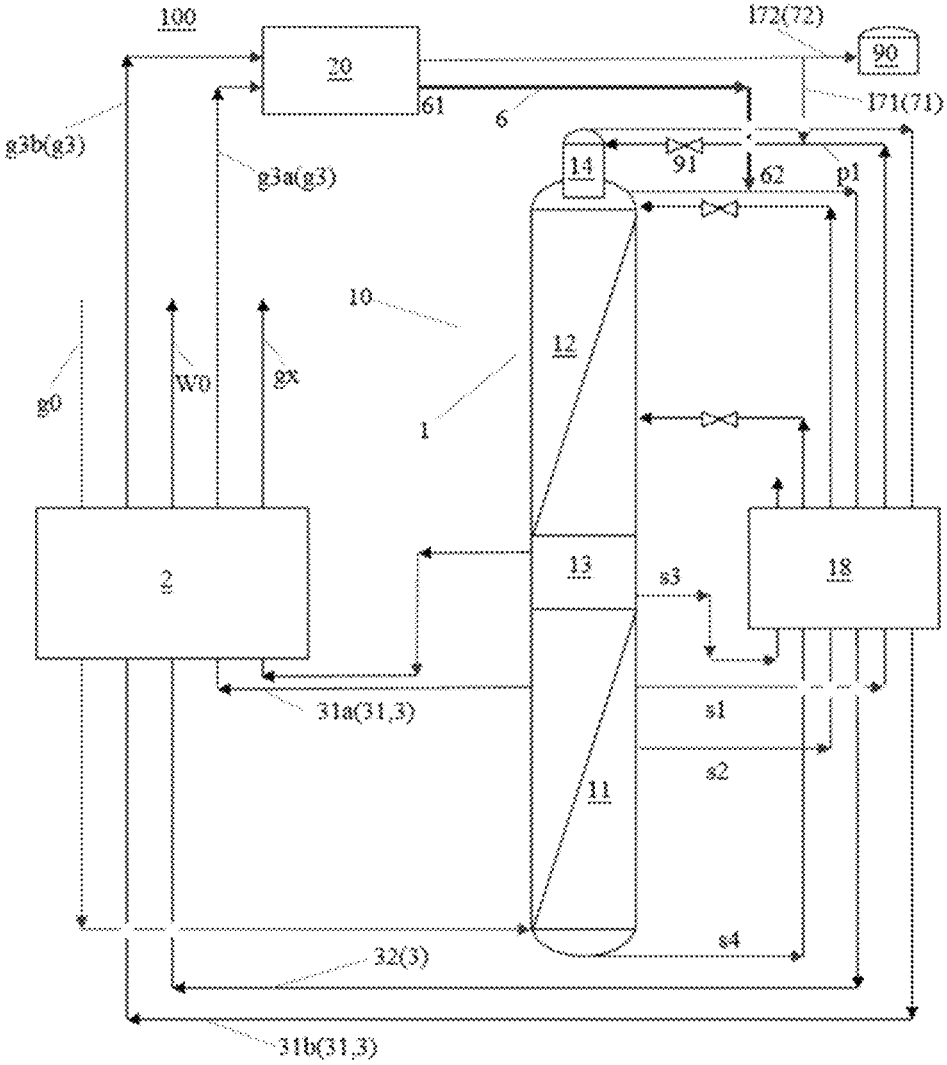
FIG. 1 is a schematic diagram of an exemplary air separation system, in particular an air separation apparatus thereof.

Specific embodiments of the present invention are described in details below with reference to the accompanying drawings. However, it should be understood that the present invention is not limited to such embodiments described below, and the technical concept of the present invention can be implemented in combination with other commonly known techniques or functions, or with other techniques identical to those commonly known techniques.

The terms "first", "second" and the like are only used for descriptive purposes rather than limiting chronological order, quantity, or importance, should not be construed as indicating or implying relative importance or implicitly specifying the number of technical features indicated, and are only intended to differentiate one technical feature from another technical feature in the present technical solution. Hence, a feature defined with "first" and "second" may explicitly or implicitly include one or a plurality of the feature. In the description of the present invention, "a plurality of" or "multiple" means two or more than two, unless otherwise clearly specified. Likewise, qualifiers similar to "a" appearing herein do not indicate a limitation of quantity, but describe a technical feature that has not appeared in the preceding text. Likewise, unless modified by a specific quantitative quantifier, a noun herein shall be regarded as including both the singular form and the plural form, and the technical solution may include a single one of the technical feature or a plurality of the technical feature. Likewise, modifiers similar to "approximately" and "about" appearing before numerals herein usually include the numeral, and the specific meaning thereof should be understood with reference to the context.

It should be understood that, in the present invention, "at least one (time)" means one (time) or multiple (times). The expression "and/or" is used to describe the associative relationship between associated objects, and indicates that three relationships may exist. As used herein, the term "and/or" includes any and all combinations of one or more of the associated items listed. Unless otherwise stated, all terms (including technical and scientific terms) used herein have the same meanings as commonly understood by those skilled in the art. It should also be understood that terms, such as those defined in commonly used dictionaries, should be construed to have meanings consistent with their meanings in the context of this description and the related art, and should not be interpreted in an idealised or excessively formal sense, unless expressly specified herein. Details of well-known functions or configurations may be omitted for brevity and/or clarity.

As mentioned above, the inventors find that many problems are associated with the use of liquid nitrogen stored externally in reserve for providing the cold needed for start-up. In addition, the inventors further find that users who have not constructed a backup system for storing a large amount of liquid nitrogen generally have a preference for equipping a nitrogen liquefier, so as to be able to obtain liquid nitrogen at any time. For these reasons, the present invention is provided.

Figure 2:
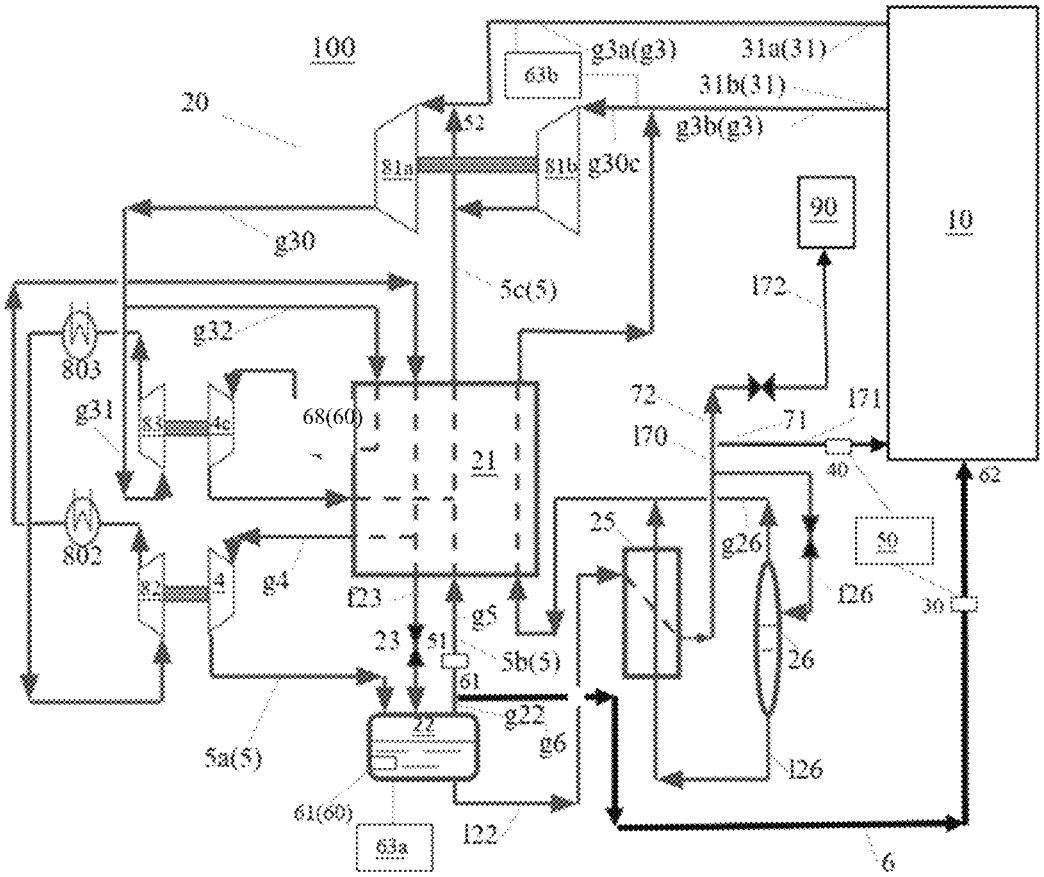
FIG. 2 is a schematic diagram of an exemplary air separation system, in particular a nitrogen liquefier thereof.

FIGS. 1 and 2 together show an exemplary configuration of an air separation system 100. The air separation system 100 comprises an air separation apparatus 10 and a nitrogen liquefier 20. FIG. 1 shows an exemplary configuration of the air separation apparatus 10 in more details, while FIG. 2 shows an exemplary configuration of the nitrogen liquefier 20 in more details.

It will be understood that both of the drawings herein merely serve as examples, and are not necessarily drawn to scale, and should not be taken as a limitation of the protection scope actually claimed for the present invention.

As shown in FIG. 1, the air separation apparatus 10 comprises a rectification column system 1, a main heat exchanger 2 and multiple output pipelines 3. The multiple output pipelines 3 are led out from the rectification column system 1 via the main heat exchanger 2.

The "rectification column system" generally comprises at least one rectification column, and thus may be a single-column or a multi-column, e.g. a dual-column configuration. In the rectification column system, the feedstock air is separated into various air products, such as nitrogen, oxygen and argon, etc., in a low-temperature atmosphere, at least a part of which is at a temperature of 150K or below; this process is often referred to as cryogenic air separation. The air products may be in liquid form or gaseous form. The term "rectification column" means a distillation or fractionation column or zone in which liquid and gas phases are in counter-current contact to effectively separate a fluid mixture.

In the "main heat exchanger", the feedstock air generally exchanges heat indirectly with an output stream (also called a return stream) from the rectification column system; thus, the feedstock air is cooled, while the output stream is reheated. The main heat exchanger may be formed of a single heat exchanger section or multiple heat exchanger sections connected in parallel and/or series. Each heat exchanger section is for example formed of one or more plate-type heat exchanger block. The plate-type heat exchanger block may have channels which have heat exchange surfaces and are separated from one another, with different streams flowing through different channels, thereby respectively cooling or heating. Commonly, the main heat exchanger may be a brazed aluminium plate-fin heat exchanger (BAHX). The expression "fully cooled" means that a to-be-cooled stream enters the main heat exchanger at a hot end, and is then cooled to a cold-end temperature of the main heat exchanger, i.e. the cooled stream exits from a cold end of the main heat exchanger. The expression "partially cooled", on the other hand, means that a to-be-cooled stream is cooled to an intermediate temperature between a hot-end temperature and the cold-end temperature of the main heat exchanger, i.e. the cooled stream is extracted at an intermediate position between the hot end and cold end of the main heat exchanger.

The output pipelines 3 are led out from the rectification column system 1 via the main heat exchanger 2. That is, the output pipelines 3 send the output streams, which are formed by the separation of feedstock air g0 in the rectification column system 1 and have different parameters, e.g. components, to the colder end of the main heat exchanger 2 for heating, and then send the heated streams out from the hotter end of the main heat exchanger 2. For example, the output streams include the waste gas, which may for example be discharged directly to the atmosphere via an output pipeline 3; in this case, the output pipeline 3 is a waste discharge pipeline. As another example, the output streams include an air product needed by a user, which may for example be sent directly into the necessary site via an output pipeline 3; in this case, the output pipeline 3 is a product discharge pipeline.

The multiple output pipelines 3 include a nitrogen gas pipeline 31 for outputting a nitrogen gas product g3. It will be understood that in FIG. 1, the air separation apparatus 10 not only produces a high-pressure nitrogen gas product g3*a* with a relatively high pressure, but also produces a low-pressure nitrogen gas product g3*b* with a relatively low pressure. The nitrogen gas pipelines 31 here may refer to both a high-pressure nitrogen gas pipeline 31*a* outputting the high-pressure nitrogen gas product g3*a*, and a low-pressure nitrogen gas pipeline 31*b* outputting the low-pressure nitrogen gas product g3*b*. However, this does not constitute any limitation. For example, the multiple output pipelines 3 may comprise just one nitrogen gas pipeline; in this case, when it is mentioned above that the multiple output pipelines 3 include a nitrogen gas pipeline 31, this naturally refers to that just one nitrogen gas pipeline. As another example, the multiple output pipelines 3 may comprise multiple nitrogen gas pipelines, and when it is mentioned above that the multiple output pipelines 3 include a nitrogen gas pipeline 31, this could refer to one, and not all, of the multiple nitrogen gas pipelines. As another example, in addition to producing a nitrogen gas product, the air separation apparatus 10 may also produce an oxygen product or argon product. That is, the description herein corresponding to the nitrogen gas pipeline 31 need only apply to at least one nitrogen gas pipeline 31 in the air separation apparatus 10. It will also be understood that the term "nitrogen gas product" g3 herein means a gaseous nitrogen product.

As shown in FIG. 2, the nitrogen liquefier 20 comprises an expander 4 and a gas delivery pipeline 5. The expander 4 is used to expand at least a portion of the nitrogen gas product g3 from the nitrogen gas pipeline 31. The gas delivery pipeline 5 is used to deliver a gas flow g4 expanded by the expander 4.

The expression "at least a portion of the nitrogen gas product g3" means at least a portion of the nitrogen gas product g3 sent into the nitrogen liquefier 20 from the air separation apparatus 10. In FIG. 2, the gas flow g4 expanded by the expander 4 is a portion of a nitrogen-rich gas flow g30, e.g. may account for about half, e.g. 40%-60%, of the mass flow rate of the nitrogen-rich gas flow g30. The nitrogen-rich gas flow g30 comprises the nitrogen gas product g3 (including the high-pressure nitrogen gas product g3*a* and low-pressure nitrogen gas product g3*b*). That is, the gas flow g4 expanded by the expander 4 comprises at least a portion of the nitrogen gas product g3, and therefore, it can be described that "the expander 4 is used to expand at least a portion of the nitrogen gas product g3 from the nitrogen gas pipeline 31". Similar to the description of the nitrogen gas pipeline 31 above, the nitrogen liquefier 20 may comprise multiple expanders, and when it is mentioned above that the nitrogen liquefier 20 comprises an expander 4, the expander 4 could be regarded as one of multiple expanders. For example, in FIG. 2, the nitrogen liquefier 20 in fact comprises two expanders, and when not further defined, the expander 4 may in fact refer to either one of the two expanders. The other expander in the nitrogen liquefier 20 is labelled 4*c* in FIG. 2.

The "nitrogen liquefier" is an apparatus that converts gaseous nitrogen to liquid nitrogen; principally, it compresses the gas to a high pressure, removes the compression heat via an after-cooler such as a water-cooled after-cooler, and then cause the gas to turn to liquid by generating cold through adiabatic expansion and/or throttling expansion. A nitrogen liquefier generally comprise an expander, and commonly also comprise a throttle valve, i.e. employs a combination of adiabatic expansion and throttling expansion.

The nitrogen gas product mentioned above is liquefied in the nitrogen liquefier to generate a nitrogen-rich liquid flow; in principle, the molar percentage of nitrogen in the nitrogen-rich liquid flow is the same as that of the nitrogen gas product mentioned above.

Referring to FIGS. 1 and 2, the air separation system 100 further comprises an intermediary pipeline 6. An inlet end 61 of the intermediary pipeline 6 is connected to the gas delivery pipeline 5 of the nitrogen liquefier 20. Returning to FIG. 1, an outlet end 62 of the intermediary pipeline 6 is connected to at least one output pipeline 3 of the multiple output pipelines 3 of the air separation apparatus 10 at a position between the rectification column system 1 and the main heat exchanger 2, such that the intermediary pipeline 6 delivers a gas flow to the abovementioned at least one output pipeline 3. In the illustrated embodiment, the above-mentioned at least one output pipeline 3 may be a waste discharge pipeline 32 of the air separation apparatus 10, for delivering the waste gas W0 such as waste nitrogen gas.

In the above-described air separation system 100, the intermediary pipeline 6 enables a gas flow in the gas delivery pipeline 5 of the nitrogen liquefier 20 to be delivered to an output pipeline 3 of the rectification column system 1. Thus, when starting up the air separation system 100 and in particular the air separation apparatus 10 thereof, a gas flow cooled by expansion in the expander 4 of the nitrogen liquefier 20 may be utilized to supply the cold to the air separation apparatus 10, specifically the rectification column system 1 thereof, thereby completing the start-up process, and enabling the air separation apparatus 10 to smoothly enter a normal operating stage. The air separation system 100 described above is particularly suitable for air separation apparatuses 10 containing no expander as shown in FIG. 1. Further, as the intermediary pipeline 6 leads to the waste discharge pipeline 32 and not to a product pipeline outputting an air product, such as the nitrogen gas pipeline 31, there need not be any interference to the components of the air product therein such as the nitrogen gas product g3, and it is thus possible to produce an air product meeting requirements more smoothly, and enter the normal operating stage more smoothly. The above-described air separation system 100 is also particularly suitable for air separation apparatuses 10 with no expander as shown in FIG. 1.

Compared with the need to use a reserve of liquid nitrogen stored in a backup system to start up the air separation apparatus, the above-described air separation system 100 utilizes a gas flow cooled by expansion in the expander 4 in the nitrogen liquefier 20 to supply the cold needed for start-up to the air separation apparatus 10, and this can make the cooling rate of the entire air separation system 100 easier to control. This is because the temperature of the gas flow cooled by expansion in the expander 4 in the nitrogen liquefier 20 will gradually drop as the start-up process goes; thus, cooling of the entire air separation system 100 will be slower at first, but gradually speed up later on. This is very friendly to the various components inside the whole air separation system 100, especially the heat exchanger, and it's less likely to cause faults such as material deformation due to a sudden drop in temperature. Moreover, the above-described air separation system 100 makes full use of the nitrogen liquefier 20 itself which is equipped by many plants, so it can significantly reduce the economic cost of storing liquid nitrogen in reserve. This is very beneficial, especially for users located in remote areas who have difficulty obtaining reserves of liquid nitrogen.

As shown in FIG. 2, the nitrogen liquefier 20 further comprises a internal heat exchanger 21, a gas-liquid separator 22 and a throttle valve 23.

In FIG. 2, the gas delivery pipeline 5 delivers the gas flow g4 from the expander 4 to the internal heat exchanger 21 for heating. As will be mentioned below, in the illustrated embodiment, a gas flow g5 sent to the internal heat exchanger 21 by the gas delivery pipeline 5 is at least a portion of a gas flow g22; when the intermediary pipeline 6 does not split flow, the gas flow g5 is all of the gas flow g22, but when the intermediary pipeline 6 splits flow, the gas flow g5 is a portion, not all, of the gas flow g22. At the same time, the gas flow g22 comprises the gas flow g4 expanded by the expander 4. That is, the gas flow g5 sent to the internal heat exchanger 21 by the gas delivery pipeline 5 is not completely the gas flow g4 expanded by the expander 4. However, since at least a portion of the gas flow g4 expanded by the expander 4 is delivered via the gas delivery pipeline 5 to the internal heat exchanger 21 for heating, it can still be described herein that "the gas delivery pipeline 5 delivers the gas flow g4 from the expander 4 to the internal heat exchanger 21 for heating".

In FIG. 2, the gas-liquid separator 22 is located on the gas delivery pipeline 5 and between the expander 4 and the internal heat exchanger 21.

It will be understood that the terms "pipeline", "pipe section" and "duct", etc. used herein all refer to lines allowing the passage of streams, and do not limit the physical form of the corresponding elements. Taking the term "pipeline" as an example, this may refer to one section in an integral pipe. The pipeline may also be a combination of multiple pipes connected sequentially. The multiple pipelines may be connected by pipe connectors, or by other pipeline elements such as valves, etc. A space allowing the passage of a stream in the pipe connector or other pipeline element may also be regarded as part of the pipeline. For example, in FIG. 2, the gas delivery pipeline 5 may in fact comprise a pipe section 5*a* communicating the expander 4 with the gas-liquid separator 22, and may also comprise a pipe section 5*b* communicating the gas-liquid separator 22 with the internal heat exchanger 21, and may also comprise a space inside the gas-liquid separator 22 allowing the passage of a gas flow, and may even also comprise a space inside the internal heat exchanger 21 allowing the passage of the gas flow g5 and a pipe section 5*c* exiting the hot end of the internal heat exchanger 21. Thus, it can be described that "the gas-liquid separator 22 is located on the gas delivery pipeline 5".

The gas-liquid separator 22 collects the gas flow g4 which has been expanded by the expander 4 and a stream f23 which has been throttled by the throttle valve 23, and separates all of the collected fluids (including the gas flow g4 and the stream f23) into a gas phase flow g22 and a liquid phase flow 122. It will be understood that the gas phase flow g22 constitutes the gas flow g22 delivered downstream from the gas-liquid separator 22 by the gas delivery pipeline 5 (specifically, pipe section 5*b*). It will be understood that when the terms "upstream" and "downstream" are used herein to describe relative orientations, they are always described relative to the flow direction of the stream in the corresponding pipeline.

In FIG. 2, the inlet end 61 of the intermediary pipeline 6 may be connected to the gas delivery pipeline 5 at a position between the expander 4 and the internal heat exchanger 21. Further, the inlet end 61 of the intermediary pipeline 6 may be connected to the gas delivery pipeline 5 at a position between the gas-liquid separator 22 and the internal heat exchanger 21.

As shown in FIG. 2, the nitrogen liquefier 20 further comprises a liquid return pipeline 71 and a liquid delivery pipeline 72. The liquid return pipeline 71 is used to send a first part of liquid flow 171 in the liquid phase flow 122 separated out by the gas-liquid separator 22 back to the rectification column system 1. Further referring to FIG. 1, the first part of liquid flow 171 delivered by the liquid return pipeline 71 is merged into an input pipeline p1 that delivers a stream to the rectification column system 1 at the highest position. In other words, in the air separation apparatus 10, there are multiple input pipelines delivering streams to the rectification column system 1. For example, in addition to the input pipeline p1 delivering a stream s1, there are also input pipelines delivering streams s2 and s4, etc. In FIG. 1, among these multiple input pipelines, the input pipeline p1 delivering the stream s1 has the highest injection height, and the first part of liquid flow 171 is merged into the input pipeline p1. The first part of liquid flow 171 converges with the nitrogen-rich stream s1 which is about to enter the pure nitrogen column 14 (often called a minaret) as a reflux liquid, and enters the pure nitrogen column 14 together with the nitrogen-rich stream s1, i.e. returns into the rectification column system 1. This helps the cold within the liquid flow 171 to be distributed throughout the rectification column system 1 more uniformly. Further, the liquid return pipeline 71 and the input pipeline p1 converge at a position between a throttle valve 91 and a sub-cooler 18. That is, the liquid flow 171 and the nitrogen-rich stream s1 enter the pure nitrogen column 14 together after be throttled, thereby reducing flash evaporation.

The liquid delivery pipeline 72 is used to output a second part of liquid flow 172 in the liquid phase flow 122 separated out by the gas-liquid separator 22 to a storage tank 90. That is, a part of liquid flow 171 in the liquid phase flow 122 flows back into the rectification column system 1 as a reflux liquid, while another part of liquid flow 172 in the liquid phase flow 122 is stored in the storage tank 90 directly. In FIG. 2, the liquid phase flow 122 exiting the gas-liquid separator 22 will in fact subsequently further undergo a series of processing steps, being split into a liquid flow 170 and a stream f26, and the liquid flow 170 is further split into the liquid flow 171 and the liquid flow 172, as will be described below. In the illustrated embodiment, the liquid flow 170 formed by liquefaction of the nitrogen gas product g3 in the nitrogen liquefier 20 has a similar composition to that of high-purity liquid nitrogen. Taking high-purity liquid nitrogen as an example, the term "high-purity" herein means a nitrogen-rich liquid with a nitrogen content exceeding 99%, preferably 99.999% as a molar percentage.

Continuing to refer to FIG. 2, in the nitrogen liquefier 20, an outlet end 52 of the gas delivery pipeline 5 is connected to the nitrogen gas pipeline 31, so as to send the gas flow g5 which has been heated in the internal heat exchanger 21 to the nitrogen gas pipeline 31, to converge with the nitrogen gas product g3 in the nitrogen gas pipeline 31. In the figure, the gas flow g5 which has been heated in the internal heat exchanger 21 is sent to the high-pressure nitrogen gas pipeline 31*a*, and converges with the high-pressure nitrogen gas product 3*a*.

Continuing to refer to FIG. 2, the air separation system 100 may further comprise a gas flow regulating component 30, a liquid flow regulating component 40, a controller 50 and a detection element 60, etc.

The gas flow regulating component 30 may be used to regulate the flow rate of a gas flow g6 in the intermediary pipeline 6. The liquid flow regulating component 40 may be used to regulate the flow rate of the liquid flow 171, 172 in the liquid return pipeline 71 and/or the liquid delivery pipeline 72. The controller 50 may control the gas flow regulating component 30 and/or the liquid flow regulating component 40 according to a control signal. The detection element 60 may send a detection signal to the controller 50. The controller 50 may generate the control signal according to the detection signal of the detection element 60. That is, the controller 50 may generate the control signal according to the detection signal from the detection element 60, and thus control the gas flow regulating component 30 and/or the liquid flow regulating component 40. In FIG. 2, the connections of the controller 50 to the gas flow regulating component 30 and the liquid flow regulating component 40, etc. are shown schematically, but the connection of the controller 50 to the detection element 60, etc. is not shown, to simplify the drawing. It will be understood that transmission between the different types of signals may employ wired connection or wireless connection.

The gas flow regulating component 30 may for example be a switch valve, disposed on the intermediary pipeline 6 for example. The intermediary pipeline 6 may be opened or closed by the on/off switching of the switch valve, thereby realizing switching of the flow rate in the intermediary pipeline 6 between zero and a maximum flow rate value, i.e. regulating the flow rate of the gas flow g6 in the intermediary pipeline 6. Alternatively, the gas flow regulating component 30 may be a regulating valve whose degree of opening can be regulated continuously or non-continuously, wherein the flow rate of the gas flow g6 in the intermediary pipeline 6 can be varied continuously or non-continuously by regulating the degree of opening. Likewise, the liquid flow regulating component 40 may for example comprise switch valves or regulating valves respectively disposed on the liquid return pipeline 71 and the liquid delivery pipeline 72. The detection element 60 may for example comprise a liquid level sensor 68 for measuring a liquid level in the gas-liquid separator 22, and may also for example comprise composition analysers 63*a*, 63*b* for detecting the nitrogen purity in the nitrogen gas pipeline 31 of the air separation apparatus 10 and/or the gas-liquid separator 22 of the nitrogen liquefier 20. A detailed description will be given below of how to specifically perform control according to the detection signal of the detection element 60.

The present invention further provides an air separation method. The air separation method uses the air separation system 100 described above. In the air separation method, at a start-up stage ST1 of the air separation apparatus 10 of the air separation system 100, the gas flow g6 is delivered to at least one output pipeline 3 of the air separation apparatus 10 from the nitrogen liquefier 20 of the air separation system 100, via the intermediary pipeline 6 of the air separation system 100.

The term "start-up stage" means a stage in which the entire air separation apparatus 10 has just been switched on, but is still unable to produce up-to-standard air products, such as an oxygen product and a nitrogen product, etc., normally. When the start-up stage ends, the air separation apparatus 10 enters an operating stage, also called the normal operating stage. At the operating stage, the air separation apparatus 10 can operate continuously, to produce up-to-standard air products.

In the air separation method, the intermediary pipeline 6 may be opened when the start-up stage ST1 begins, for example by means of a switch valve, as an example of the gas flow regulating component 30. Moreover, the liquid return pipeline 71 and the liquid delivery pipeline 72 of the nitrogen liquefier 20 are closed, for example by means of a switch valve, as an example of the liquid flow regulating component 40.

At the start-up stage ST1, the nitrogen purity in the nitrogen gas pipeline 31 of the air separation apparatus 10 and/or the gas-liquid separator 22 of the nitrogen liquefier 20 is detected, for example by means of the composition analysers 63*a*, 63*b* respectively. Moreover, the liquid level in the gas-liquid separator 22 is detected, for example by means of the liquid level sensor 68. When the liquid level in the gas-liquid separator 22 reaches a predetermined value, the liquid return pipeline 71 is opened, for example by opening a switch valve, as an example of the liquid flow regulating component 40, located on the liquid return pipeline 71. When the nitrogen purity in the nitrogen gas pipeline 31 and/or the gas-liquid separator 22 reaches a predetermined value, it is determined that the start-up stage ST1 has ended and the operating stage ST2 is entered.

At the operating stage ST2, the liquid delivery pipeline 72 is opened, for example by switching on a switch valve, as an example of the liquid flow regulating component 40, located on the liquid delivery pipeline 72. Moreover, the intermediary pipeline 6 is closed, for example by switching off a switch valve, as an example of the gas flow regulating component 30. At this time, the liquid return pipeline 71 is not closed, that is, the liquid return pipeline 71 is still kept open, that is, for example, the switch valve located on the liquid return pipeline 71 as an example of the liquid flow regulating component 40 is kept in a switch-on state.

In the air separation method described above, at the start-up stage ST1, the gas flow cooled by expansion in the expander 4 in the nitrogen liquefier 20 is delivered into the rectification column system 1 through the intermediary pipeline 6, so the cold can be continuously delivered to the air separation apparatus 10 immediately after turn-on. Moreover, at the start-up stage ST1, by detecting the liquid level, it enables the liquid flow 171 to be sent back to the rectification column system 1 promptly, further supplying the cold. The supply of cold increases gradually throughout the start-up process, so the cold produced by the expander 4 in the nitrogen liquefier 20 is not wasted, and faults due to sudden cooling just after turn-on will not arise. Moreover, once it has been determined that the operating stage ST2 has been smoothly entered, by detecting the nitrogen purity, the delivery of the gas flow through the intermediary pipeline 6 to supply the cold is promptly stopped; instead, the liquid flow 171 with a high nitrogen purity is used alone to deliver the cold to the rectification column system 1 continuously, and the excess liquid flow 172 is caused to enter the storage tank 90 for storage through the liquid delivery pipeline 72. This avoids affecting the constituents, for example, of the output stream in the output pipeline 3. Thus, switching to the operating stage of the air separation apparatus 10 can take place smoothly.

In the air separation method, at the start-up stage ST1, the rate of temperature decrease at a fixed site in the internal heat exchanger 21 of the nitrogen liquefier 20 may also be detected. That is, the temperature at the fixed site may be detected, for example by a temperature sensor internally provided at the fixed site in the internal heat exchanger 21, and the rate of temperature decrease r1, i.e. the drop in temperature per unit time, can thus be detected. Moreover, at the start-up stage ST1, the flow rate of the gas flow g5 sent to the nitrogen gas pipeline 31 by the gas delivery pipeline 5 via the internal heat exchanger 21 may be regulated, such that the detected rate of temperature decrease r1 falls 2° C./min or below. For example, a regulating valve 51 capable of regulating the flow rate may be provided on the gas delivery pipeline 5 at a position immediately upstream of the internal heat exchanger 21, and the flow rate of the gas flow g5 may be controlled by regulating the degree of opening of the regulating valve 51. Reception, processing and control, etc. of the relevant signals may be realized by the controller 50.

The rate of temperature decrease r1 at the fixed site in the internal heat exchanger 21 in the nitrogen liquefier 20 may also, to a certain extent, represent the rate of temperature decrease at any site inside the nitrogen liquefier 20 or even the air separation system 100 comprising the air separation apparatus 10. By detecting the rate of temperature decrease r1, it is possible to avoid faults due to an excessively fast rate of temperature decrease r1. Further, the gas flow g5 ultimately converges with the nitrogen gas product g3, and they together enter the expanders 4, 4*c* of the nitrogen liquefier 4 to be cooled by expansion; therefore, reducing the flow rate of the gas flow g5 can in fact reduce the flow rate of the gas flow entering the expanders 4, 4*c* for expansion, and can thus reduce the load on the expanders 4, 4*c*, thereby reducing the cooling capacity or cooling rate. Thus, this can result in slower temperature decrease at sites in the entire system, e.g. a fixed site in the internal heat exchanger 21 in the nitrogen liquefier 20. That is, the rate of temperature decrease r1 can be reduced by reducing the flow rate of the gas flow g5. In fact, the gas flow g6 supplying the cold to the rectification column system 1 is led out from the gas delivery pipeline 5, so the greater the flow rate of the gas flow g6, the smaller the flow rate of the gas flow g5 sent to the nitrogen gas pipeline 31 by the gas delivery pipeline 5 via the internal heat exchanger 21, and hence the smaller the load on the expanders 4, 4*c*, etc. downstream of the nitrogen gas pipeline 31, and the less the cold produced. Thus, the rate at which the cold is supplied can be easily regulated according to the distribution of flow rates of the gas flow g6 and the gas flow g5, so as to control the rate of temperature decrease r1. Control of the rate of temperature decrease r1 can enhance the low-temperature resistance of the entire system. In particular, with regard to the internal heat exchanger 21 in the nitrogen liquefier 20, if the temperature falls too quickly, the fins inside the internal heat exchanger 21 might easily experience cold brittleness and warpage. If the rate of temperature decrease r1 is maintained within 2° C./min, the performance of the entire system when facing a temperature drop, and the lifespan of each unit, can be significantly improved.

In an embodiment, a temperature detector for detecting temperature may also be provided in the main heat exchanger 2 of the air separation apparatus 10, so as to accurately obtain the rate of temperature decrease in the main heat exchanger 2. The rate of temperature decrease of the main heat exchanger 2 may also be regulated by regulating the flow rate of the gas flow g6. Once the liquid flow 171 is produced, the rate of temperature decrease of the main heat exchanger 2 may also be regulated by regulating the flow rate of the liquid flow 171.

An exemplary configuration and process are described in more details below with reference to FIGS. 1 and 2. Referring to FIG. 1, the rectification column system 1 of the air separation apparatus 10 may comprise a high-pressure column 11 and a low-pressure column 12, and may also comprise a main condenser-vaporiser 13 and the pure nitrogen column 14. The operating pressure of the low-pressure column 12 may be 1-2 bara, e.g. 1.1 bara, and the operating pressure of the high-pressure column 11 may be 4-6 bara, e.g. 5.5 bara. As shown in FIG. 1, the low-pressure column 12 may be vertically mounted at the top of the high-pressure column 11, the main condenser-vaporiser 13 may be located at the bottom of the low-pressure column 12, and the pure nitrogen column 14 may be located at the top of the low-pressure column 12, in communication with the low-pressure column 12. Types of the main condenser-vaporiser 13 may include a tube and shell type, a falling film type, and an immersion bath type, etc.

In FIG. 1, in addition to producing the nitrogen gas product g3, the air separation apparatus 10 also produces an oxygen gas product gx. The oxygen gas product gx is extracted from the top of the main condenser-vaporiser 13 and heated in the main heat exchanger 2, and then for example may be led out to the necessary place. The illustrated air separation apparatus 10 is not fitted with an available expander, i.e. is not equipped with an internal expander.

Feedstock air g0 is sent into the main heat exchanger 2, and exchanges heat indirectly with the low-pressure nitrogen gas product g3*b*, waste gas W0 and high-pressure nitrogen gas product g3*a*, which come from the top of the pure nitrogen column 14, the top of the low-pressure column 12 and the top of the high-pressure column 11, respectively, after rectification in the rectification column system 1; after being cooled to about −173° C. for example, the feedstock air g0 is sent into a lower part of the high-pressure column 11 to undergo rectification. The term "feedstock air" may refer to a mixture mainly comprising oxygen and nitrogen, and for example may be dry air. It will be understood that the terms "high-pressure nitrogen gas product" and "low-pressure nitrogen gas product" mean that these two nitrogen gas products have a higher and a lower pressure relative to each other. In fact, in this embodiment, the high-pressure nitrogen gas product g3*a* is for example at 5.5 bara, and is often called a low-pressure nitrogen gas product in engineering, whereas the low-pressure nitrogen gas product g3*b* is for example at 1.1 bara, and is often called an ultra-low-pressure nitrogen gas product in engineering. The waste gas W0 is for example waste nitrogen at 1.1 bara, with a nitrogen content generally not lower than 95% as a molar percentage.

It will be understood that when a stream is described as sequentially entering a first element and a second element or a similar description is used herein, this merely indicates the order in which the stream enters the first element and then the second element, and does not rule out a scenario in which the stream also passes through a third element between the first element and the second element, or a scenario in which the stream also passes through a third element before the first element or after the second element. For example, before being sent into the main heat exchanger 2, although not shown, the feedstock air g0 may be compressed in a main air compressor, e.g. pressurized to about 6 bara, and may also then undergo pre-cooling and purification.

The low-pressure nitrogen gas product g3*b* and waste gas W0 respectively coming from the top of the pure nitrogen column 14 and the top of the low-pressure column 12 are heated in the sub-cooler 18, specifically entering through a cold end and exiting from a hot end, thereby providing the cold required for heat exchange in the sub-cooler 18. The sub-cooler 18 can sub-cool an oxygen-rich stream s4 extracted from the bottom of the high-pressure column 11, which, after sub-cooled in the sub-cooler 18, is sent into a middle part of the low-pressure column 12 as a relux liquid. The sub-cooler 18 can also sub-cool a nitrogen-rich stream s1 extracted from the top of the high-pressure column 11, which, after sub-cooled in the sub-cooler 18, is further throttled and sent into the pure nitrogen column 14, as a relux liquid.

In FIG. 1, after extracted from the bottom of the main condenser-vaporiser 13 at the bottom of the low-pressure column 12, and then sub-cooled in the sub-cooler 18, low-pressure high-purity liquid oxygen s3 is formed, which for example may be sent into a liquid oxygen storage tank for reserve.

Referring to FIG. 2, in addition to the units mentioned above, the nitrogen liquefier 20 generally also comprises a compressor, such as 81*a*. In the nitrogen liquefier 20, the nitrogen gas product g3 is generally pressurized by at least one compressor e.g. 81*a*, has compression heat removed therefrom via an after-cooler, then is caused to expand and thus drop in temperature through adiabatic expansion in at least one expander e.g. 4 and optional throttling expansion in at least one throttle valve e.g. 23 which to produce the cold; the stream obtained through the adiabatic expansion and throttling expansion generally consists of a gas phase and a liquid phase, so further undergoes a gas-liquid separation in at least one gas-liquid separator e.g. 22, thereby a nitrogen-rich liquid flow obtained.

In this embodiment, the nitrogen liquefier further comprises a booster 82 and a booster 83. The expanders 4, 4*c* do work to provide a driving power for the boosters 82, 83 respectively. The high-pressure nitrogen gas product g3*a* produced by the air separation apparatus 10 is delivered to the compressor 81*a* in the nitrogen liquefier 20. In the nitrogen liquefier 20, the nitrogen-rich gas flow g30 comprising the high-pressure nitrogen gas product g3*a* is pressurized in the compressor 81*a*, for example reaching 30 bara. The nitrogen-rich gas flow g30 pressurized in the compressor 81*a* is split into two parts: a first part of nitrogen-rich gas flow g31 and a second part of nitrogen-rich gas flow g32.

The first part of nitrogen-rich gas flow g31 enters the booster 83 and the booster 82 successively to be pressurized, for example reaching 65 bara. After cooled in after-coolers 802 and 803, it enters the internal heat exchanger 21 and is split into two streams: the stream g4 (simply called the gas flow g4 herein) and the stream f23.

The gas flow g4 is extracted from the internal heat exchanger 21 at a middle position thereof and enters the expander 4 to expand, for example dropping in pressure to 5.5 bara. The gas flow g4 expanded by the expander 4 is delivered to the gas-liquid separator 22 via the pipe section 5*a* of the gas delivery pipeline 5.

The stream f23 is throttled by the throttle valve 23 after cooled in the internal heat exchanger 21, for example also dropping in pressure to 5.5 bara, and is also delivered to the gas-liquid separator 22.

The gas phase and liquid phase of the streams sent into the gas-liquid separator 22 (including the gas flow g4 and the stream f23) are separated in the gas-liquid separator 22, so as to form the gas phase flow g22 and the liquid phase flow 122. At least a portion (simply called the gas flow g5 herein) of the gas phase flow g22 returns to the internal heat exchanger 21 via the pipe section 5*b* of the gas delivery pipeline 5 to be heated, then merges with the high-pressure nitrogen gas product g3*a* and is delivered to the inlet of the compressor 81*a*. An optional portion (called the gas flow g6 herein) of the gas phase flow g22 may be delivered to the rectification column system 1 in the air separation apparatus 10 via the intermediary pipeline 6 at the start-up stage ST1.

After partially cooled in the internal heat exchanger 21, the second part of nitrogen-rich gas flow g32 is extracted from the internal heat exchanger 21 at a middle position thereof, and then enters the expander 4*c* to expand, for example dropping in pressure to about 5.5 bara. The second part of nitrogen-rich gas flow g32 expanded by the expander 4*c* then returns to the internal heat exchanger 21 at a middle position thereof, and merges with the gas flow g5 in the internal heat exchanger 21. The two gas flows are then heated together. The nitrogen-rich gas flow g30 consists of at least the high-pressure nitrogen gas product g3*a*, the gas flow g5 and the second part of nitrogen-rich gas flow g32. By the way, due to circulation, the sum of the mass flow rates of the gas flow g5 and the second part of nitrogen-rich gas flow g32 in fact may even be greater than the mass flow rate of the nitrogen gas product g3, so in fact, the mass flow rate of the nitrogen-rich gas flow g30 may even reach several times, e.g. six times, of the mass flow rate of the nitrogen gas product g3.

In FIG. 2, the nitrogen liquefier further comprises another compressor 81*b*, another internal heat exchanger 25 and another gas-liquid separator 26. The low-pressure nitrogen gas product g3*b* produced by the air separation apparatus 10 is delivered to the compressor 81*bin* the nitrogen liquefier 20. In the nitrogen liquefier 20, the nitrogen-rich gas flow g30*c* containing the low-pressure nitrogen gas product g3*b* is pressurized in the compressor 81*b*, for example reaching 5.5 bara, merges with the second part of nitrogen-rich gas flow g32 and the gas flow g5 heated in the internal heat exchanger 21, and then merges with the high-pressure nitrogen gas product g3*a*, for delivery to the inlet of the compressor 81*a* together.

At least a part of stream f26 of the liquid phase flow 122 is dropped in pressure to e.g. about 1.1 bara after throttling, and then delivered to the gas-liquid separator 26. In the gas-liquid separator 26, the gas phase and the liquid phase are separated, to form a gas phase flow g26 and a liquid phase flow 126. The gas phase flow g26 returns to the internal heat exchanger 21 to be heated, then merges with the low-pressure nitrogen gas product g3*b*, for delivery to the inlet of the compressor 81*b* together. The liquid phase flow 126 exchanges heat with the liquid phase flow 122 in the internal heat exchanger 25, then merges with the gas phase flow g26 and returns to the internal heat exchanger 21. The nitrogen-rich gas flow g30*c* consists of at least the low-pressure nitrogen gas product g3*b*, the gas phase flow g26, and the liquid phase flow 126 heated in the internal heat exchanger 25.

The high-pressure nitrogen gas product g3*a* and the low-pressure nitrogen gas product g3*b* are liquefied in the nitrogen liquefier 20 to produce a nitrogen-rich liquid flow (mainly consisting of the liquid phase flow 122). At the normal operating stage, a part of liquid flow 171 is led back into the air separation apparatus 10, in particular into the rectification column system 1, and another part of liquid flow 172 is led into the storage tank 90 for example, for reserve. The nitrogen-rich liquid flow will experience loss of cold and thus gasification in the process of being delivered over a large distance to the liquid nitrogen storage tank; in consideration of this, the internal heat exchanger 25 and the gas-liquid separator 26 are added, mainly for the purpose of further cooling the liquid flow 172.

Referring to FIGS. 1 and 2, the high-pressure nitrogen gas product g3*a* at 5.5 bara from the top of the high-pressure column 11 and the low-pressure nitrogen gas product g3*b* at 1.1 bara from the pure nitrogen column 14 are heated in the main heat exchanger 2, and then led to the inlets of the compressor 81*a* and the compressor 81*b* in the nitrogen liquefier 20, respectively. At the start-up stage ST1, a part of gas flow g6 resulting from cooling of the high-pressure nitrogen gas product g3*a* and the low-pressure nitrogen gas product g3*b* by the expanders in the nitrogen liquefier 20 converges with the waste gas W0 outputted from the top of the low-pressure column 12, and thus supplies the cold when entering the sub-cooler 18 and the main heat exchanger 2 to be heated together with the waste gas W0. Moreover, after a period of time has elapsed since the start-up stage ST1 begins, the liquid flow 171 begins to be produced in the nitrogen liquefier 20; the liquid flow 171 merges with the nitrogen-rich stream s1 extracted from the top of the high-pressure column 11 and is sent into the top of the pure nitrogen column 14, and thus can also supply the cold. At the subsequent normal operating stage ST2, the high-pressure nitrogen gas product g3*a* and low-pressure nitrogen gas product g3*b* are liquefied in the nitrogen liquefier 20 to produce the nitrogen-rich liquid flow 170; a part of nitrogen-rich liquid flow 171 merges with the nitrogen-rich stream s1 after throttling and is sent into the pure nitrogen column 14, and another part of nitrogen-rich liquid flow 172 is led into the liquid nitrogen storage tank 90.

Unless clearly indicated otherwise, each aspect or embodiment defined herein may be combined with any other aspect(s) or embodiment(s). In particular, any preferred or advantageous feature indicated can be combined with any other preferred or advantageous feature indicated.

The embodiments described herein are merely preferred specific embodiments of the present invention, which are only intended to explain the technical solution of the present invention without limiting the present invention. All technical solutions that can be obtained by those skilled in the art by logical analysis, reasoning or limited experiment according to the concept of the present invention should fall within the scope of the present invention.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

The invention claimed is:

1. An air separation system comprising:

an air separation apparatus comprising a rectification column system, a main heat exchanger and multiple output pipelines, the multiple output pipelines being led out from the rectification column system via the main heat exchanger, and the multiple output pipelines comprising a nitrogen gas pipeline configured to output a nitrogen gas product;

a nitrogen liquefier comprising an expander configured to expand at least a portion of the nitrogen gas product from the nitrogen gas pipeline, and a gas delivery pipeline configured to deliver a gas flow expanded by the expander, wherein the nitrogen liquefier further comprises:

an internal heat exchanger in fluid communication with an outlet of the expander, such that the internal heat exchanger is configured to receive and then heat a gas flow from the expander via the gas delivery pipeline;

a gas-liquid separator, located on the gas delivery pipeline and between the expander and the internal heat exchanger;

a throttle valve, the gas-liquid separator collecting a gas flow expanded by the expander and a stream throttled by the throttle valve, and separating all collected fluids into a gas phase flow and a liquid phase flow;

a liquid return pipeline configured to send a first part of liquid flow in the liquid phase flow separated out by the gas-liquid separator back to the rectification column system; and a liquid delivery pipeline configured to output a second part of liquid flow in the liquid phase flow separated out by in the gas-liquid separator to a storage tank an intermediary pipeline, wherein, an inlet end of the intermediary pipeline is connected to the gas delivery pipeline of the nitrogen liquefier, and an outlet end of the intermediary pipeline is connected to at least one output pipeline of the multiple output pipelines of the air separation apparatus at a position between the rectification column system and the main heat exchanger, such that the intermediary pipeline delivers a gas flow to the at least one output pipeline, wherein, in the nitrogen liquefier, an outlet end of the gas delivery pipeline is connected to the nitrogen gas pipeline, so as to send a gas flow heated in the internal heat exchanger to the nitrogen gas pipeline to converge with the nitrogen gas product in the nitrogen gas pipeline, wherein the air separation system further comprises:

a gas flow regulating component configured to regulate a flow rate of a gas flow in the intermediary pipeline;

a liquid flow regulating component configured to regulate a flow rate of a liquid flow in the liquid return pipeline and/or the liquid delivery pipeline;

a controller, for controlling the gas flow regulating component and/or the liquid flow regulating component according to a control signal; and a detection element configured to send a detection signal to the controller, which generates the control signal according to the detection signal of the detection element.

2. The air separation system according to claim 1, wherein the inlet end of the intermediary pipeline is connected to the gas delivery pipeline at a position between the expander and the internal heat exchanger.

3. The air separation system according to claim 2, wherein the inlet end of the intermediary pipeline is connected to the gas delivery pipeline at a position between the gas-liquid separator and the internal heat exchanger.

4. The air separation system according to claim 1, wherein the at least one output pipeline is a waste discharge pipeline of the air separation apparatus for delivering waste gas.

5. An air separation method comprising the steps of:

providing an air separation system comprised of an air separation apparatus comprising a rectification column system, a main heat exchanger and multiple output pipelines, the multiple output pipelines being led out from the rectification column system via the main heat exchanger, and the multiple output pipelines comprising a nitrogen gas pipeline configured to output a nitrogen gas product;

a nitrogen liquefier comprising an expander configured to expand at least a portion of the nitrogen gas product from the nitrogen gas pipeline, and a gas delivery pipeline configured to deliver a gas flow expanded by the expander; and an intermediary pipeline, wherein, an inlet end of the intermediary pipeline is connected to the gas delivery pipeline of the nitrogen liquefier, and an outlet end of the intermediary pipeline is connected to at least one output pipeline of the multiple output pipelines of the air separation apparatus at a position between the rectification column system and the main heat exchanger, such that the intermediary pipeline delivers a gas flow to the at least one output pipeline;

at a start-up stage of an air separation apparatus in the air separation system, delivering a gas flow to at least one output pipeline of the air separation apparatus from the nitrogen liquefier in the air separation system, via the intermediary pipeline in the air separation system;

when the start-up stage begins, opening the intermediary pipeline, and closing a liquid return pipeline and a liquid delivery pipeline in the nitrogen liquefier;

at the start-up stage, detecting nitrogen purity in a nitrogen gas pipeline of the air separation apparatus and/or a gas-liquid separator in the nitrogen liquefier, and detecting a liquid level in the gas-liquid separator:

when the liquid level in the gas-liquid separator reaches a predetermined value, opening the liquid return pipeline:

when the nitrogen purity in the nitrogen gas pipeline and/or the gas-liquid separator reaches a predetermined value, determining that the start-up stage has ended and an operating stage is entered; and at the operating stage, opening the liquid delivery pipeline, and closing the intermediary pipeline.

6. The air separation method according to claim 5, wherein at the start-up stage, further comprising the steps of: detecting a rate of temperature decrease at a fixed site in an internal heat exchanger of the nitrogen liquefier, and regulating the flow rate of a gas flow sent to the nitrogen gas pipeline by the gas delivery pipeline via the internal heat exchanger, such that the detected rate of temperature decrease is within 2° C./min.

* * * * *